US008511089B2

(12) United States Patent
Bastnagel et al.

(10) Patent No.: US 8,511,089 B2
(45) Date of Patent: Aug. 20, 2013

(54) RELIEF SLOT FOR COMBUSTION LINER

(75) Inventors: Philip Michael Bastnagel, Indianapolis, IN (US); Jack Dwayne Petty, Indianapolis, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 1045 days.

(21) Appl. No.: 12/533,467

(22) Filed: Jul. 31, 2009

(65) Prior Publication Data

US 2011/0023496 A1 Feb. 3, 2011

(51) Int. Cl.
*F23R 3/002* (2006.01)

(52) U.S. Cl.
USPC ..... 60/752; 60/754

(58) Field of Classification Search
USPC ..... 60/752, 754–760
See application file for complete search history.

(56) References Cited

U.S. PATENT DOCUMENTS

| | | | | |
|---|---|---|---|---|
| 3,751,910 | A | | 8/1973 | Sweeney et al. |
| 4,030,875 | A | | 6/1977 | Grondahl et al. |
| 5,181,379 | A | | 1/1993 | Wakeman et al. |
| 5,233,828 | A | | 8/1993 | Napoli |
| 5,241,827 | A | | 9/1993 | Lampes |
| 5,261,223 | A | | 11/1993 | Foltz |
| 5,279,127 | A | | 1/1994 | Napoli |
| 5,850,895 | A | * | 12/1998 | Evrard ..... 188/264 A |
| 5,980,240 | A | * | 11/1999 | Krautzig et al. ..... 431/285 |
| 6,131,384 | A | * | 10/2000 | Ebel ..... 60/797 |
| 6,351,949 | B1 | | 3/2002 | Rice et al. |
| 6,547,518 | B1 | | 4/2003 | Czachor et al. |
| 6,581,386 | B2 | | 6/2003 | Young et al. |
| 6,681,577 | B2 | * | 1/2004 | Bolender et al. ..... 60/772 |
| 6,691,515 | B2 | | 2/2004 | Verdouw et al. |
| 6,792,757 | B2 | | 9/2004 | Borns et al. |
| 7,097,422 | B2 | * | 8/2006 | Rice et al. ..... 415/134 |
| 2008/0010997 | A1 | * | 1/2008 | Bessagnet et al. ..... 60/805 |

* cited by examiner

*Primary Examiner* — William H Rodriguez
*Assistant Examiner* — Carlos A Rivera
(74) *Attorney, Agent, or Firm* — McCormick, Paulding & Huber LLP

(57) ABSTRACT

A combustion liner has an aft seal ring defines a relief slot in a wall of the combustion liner. The relief slot defined in the wall includes a first slot portion extending from a first end of the wall to a termination point. An arcuate slot portion intersects the termination point of the first slot portion, and a generally circular aperture is defined in the wall at each end of the arcuate slot portion.

12 Claims, 3 Drawing Sheets

RELIEF SLOT FOR COMBUSTION LINER

FIELD OF THE INVENTION

The present invention is directed generally to relief slots defined in combustion liners, and more particularly to an advanced geometry relief slot for relieving hoop stress in structures.

BACKGROUND OF THE INVENTION

Thin wall combustion liners are used throughout the industry in commercial, industrial, and military gas turbine engine applications. The purpose of the combustion liner walls are to provide a pressure drop for mixing and burning of fuel and air inside the gas turbine. The hot air is then directed into the turbine by the liner wall contours. The pressure drop for mixing is provided by the cooling air circuits (holes and slots), the dome and fuel nozzle air swirlers, and the liner dilution holes.

Gas turbine engines have incorporated axially cut keyhole relief slots in the aft seal rings of the combustion liner to reduce the hoop stress. Conventional keyhole slot geometry on combustion liners includes a round or elliptical stop drill hole at the root or base of the slot. Combustion liner aft seal rings are known to suffer from cracks initiating at the keyhole relief slots. These keyhole slots are typically distributed circumferentially around the liner to reduce the hoop stress fight experienced in the combustion liner aft seal ring. However, the shape of the relief slot can tend to contribute to crack initiation and other fatigue cracks in the aft seal rings adjacent to the relief slot because of sharp geometric notches and associated high Kt's (stress concentrations) in the local high hoop stress field.

There is a continuing need for technology development relating to modifying relief slots so as to increase crack initiation and fatigue growth life of the region in the aft seal rings experiencing a high hoop stress. More specifically, there is a continuing need to develop an advanced geometry slot configured for moving the high Kt features of the slot out of a high stress region to specifically enhance component service life. The present invention satisfies this need in a novel and non-obvious way.

SUMMARY OF THE INVENTION

In one aspect of the present invention, a structure configured for relieving hoop stress comprises a wall defining a relief slot therein. The relief slot defined in the wall includes a first slot portion extending from a first end of the wall to a termination point. An arcuate slot portion intersects the termination point of the first slot portion, and a generally circular aperture is defined in the wall at each end of the arcuate slot portion.

In a second aspect of the present invention, a combustion liner comprises an aft seal ring defining a relief slot in a wall of the combustion liner. The relief slot defined in the wall includes a first slot portion extending from a first end of the wall to a termination point. An arcuate slot portion intersects the termination point of the first slot portion, and a generally circular aperture is defined in the wall at each end of the arcuate slot portion.

In a third aspect of the present invention, an aft seal ring of a combustion liner comprises a wall defining a relief slot. The relief slot defined in the wall includes a first slot portion extending from a first end of the wall to a termination point. An arcuate slot portion intersects the termination point of the first slot portion, and a generally circular aperture is defined in the wall at each end of the arcuate slot portion.

DETAILED DESCRIPTION OF THE PREFERRED EMBODIMENTS

Figure 1:
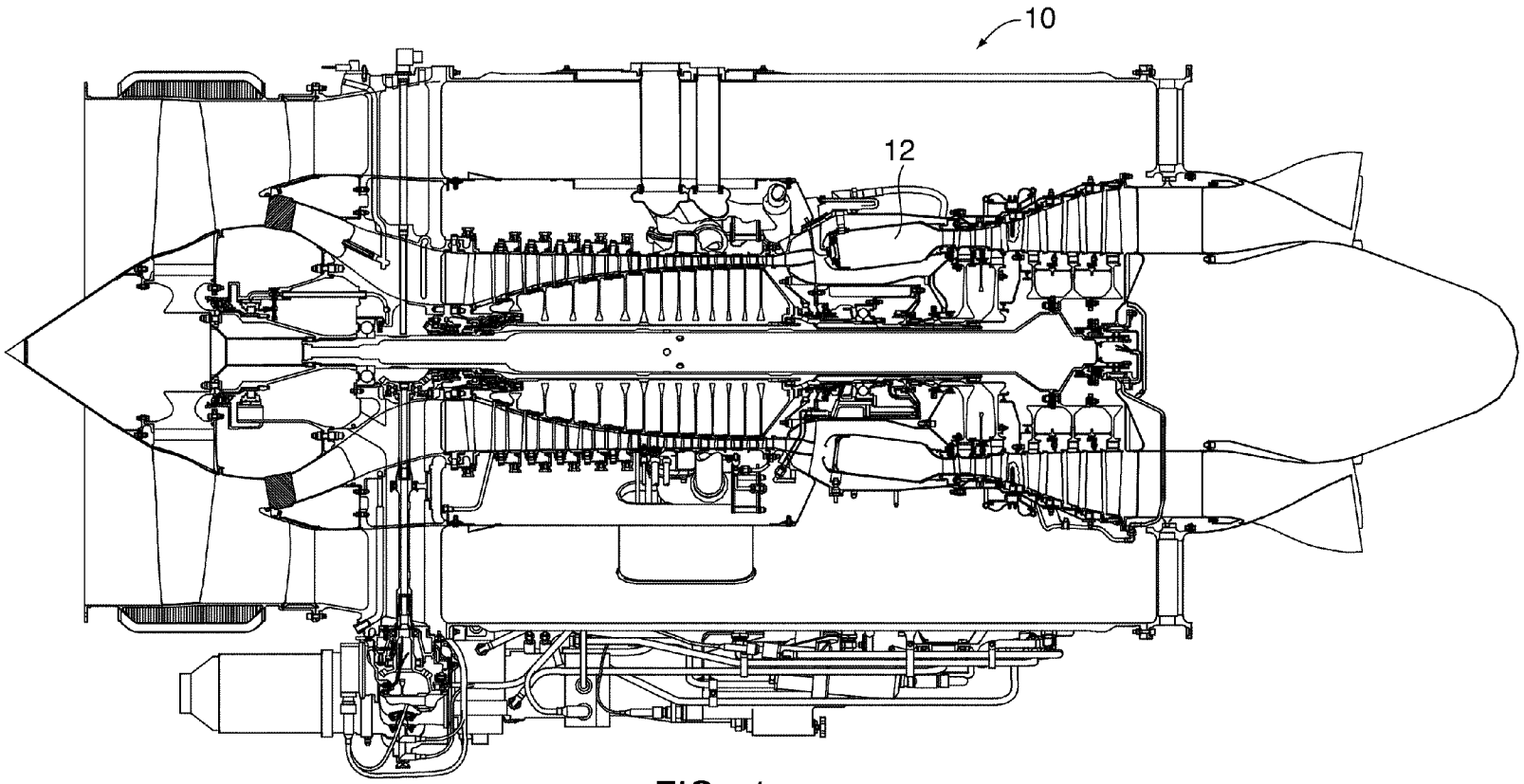
FIG. 1 is a cross-sectional view of a gas turbine engine incorporating a combustion liner in accordance with the present invention.
Figure 2:
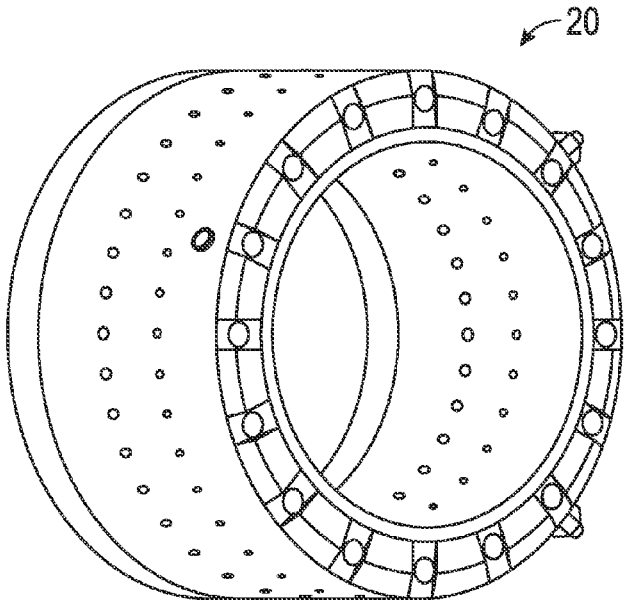
FIG. 2 is a perspective view of a combustion liner.

FIG. 1 is a cross-sectional view of a gas turbine engine 10 illustrating, by way of example only, a context for implementing the advanced geometry relief slot for relieving hoop stress in accordance with the present invention. The gas turbine engine 10 includes a combustion liner 12 which typically experiences hoop stress generated therein. The advanced geometry relief slot embodying the present invention and to be explained more fully hereinbelow is implemented in, for example, the combustion liner 12 to reduce hoop stress and to prevent or forestall the generation of cracks or the onset of other types of structural fatigue in the vicinity of the relief slot defined in the wall of the combustion liner. For clarity of illustration, FIG. 2 shows an example of a combustion liner 20 separate from other engine components. Although an advanced geometry relief slot can be implemented in a combustion liner of a gas turbine engine, it should be understood that a relief slot in accordance with the present invention can be implemented in other structures or walls that typically experience hoop stress.

Figure 3:
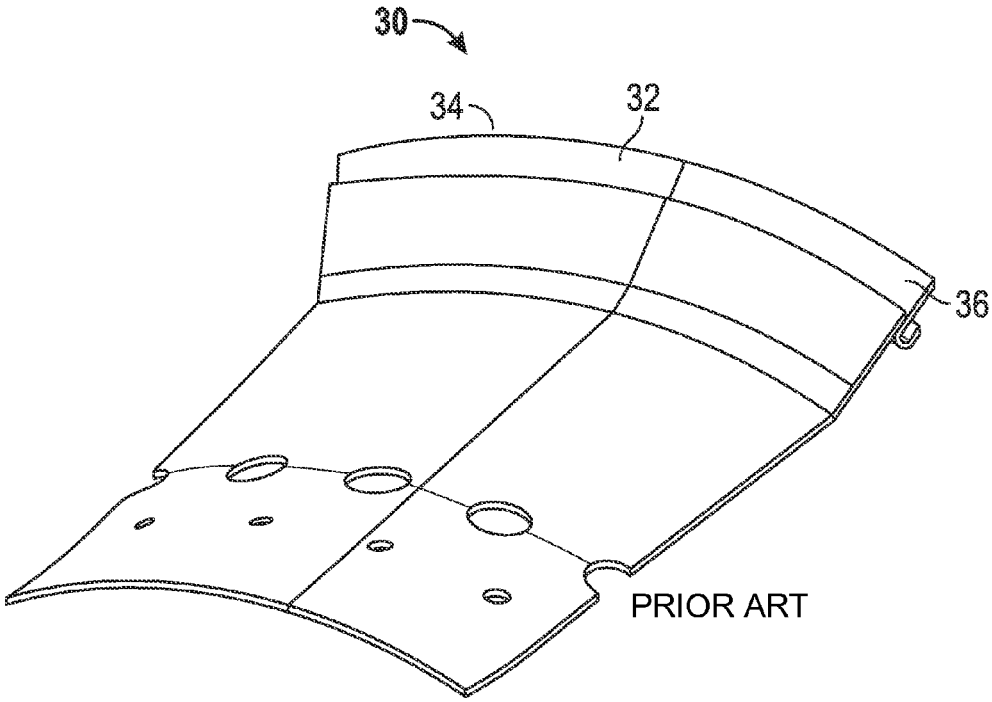
FIG. 3 is a perspective view of a portion of a combustion liner wall defining a relief slot.
Figure 4:
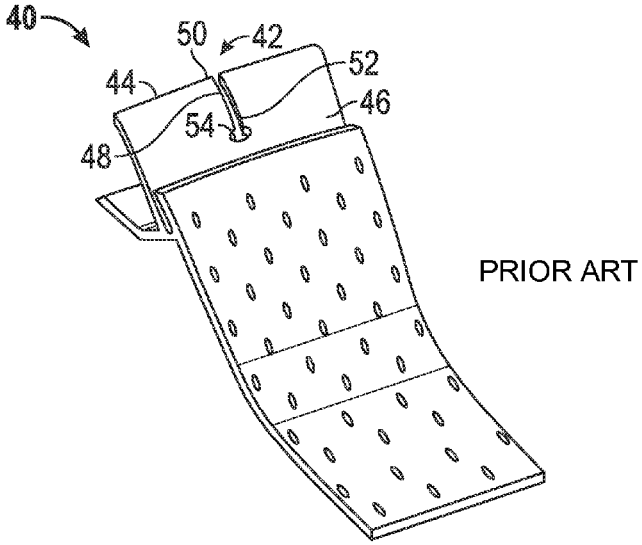
FIG. 4 is an enlarged perspective view of a portion of a combustion liner wall defining a conventional keyhole relief slot.

FIG. 3 illustrates the location of a relief slot in a portion of a combustion liner. As shown in FIG. 3, a combustion liner 30 defines a relief slot 32 at an upper end 34 of a wall 36 of the combustion liner. FIG. 4 is an enlarged view of a portion of a combustion liner 40 defining a conventional keyhole relief slot 42 at an upper end 44 of a wall 46 of the combustion liner for relieving hoop stress. The keyhole relief slot 42 defined in the wall or aft seal ring 46 of the combustion liner 40 includes a first slot portion 48 extending from a first end 50 of the wall 46 to a base or termination point 52. The keyhole relief slot 42 defined by the wall 46 further has a round or elliptical stop drill hole 54 at the base or termination point 52. As mentioned above, the shape of conventional keyhole relief slots can tend to contribute to crack initiation and other fatigue cracks in the aft seal rings adjacent to the relief slot because of sharp geometric notches and associated high Kt's (stress concentrations) in the local high hoop stress field.

Figure 5:
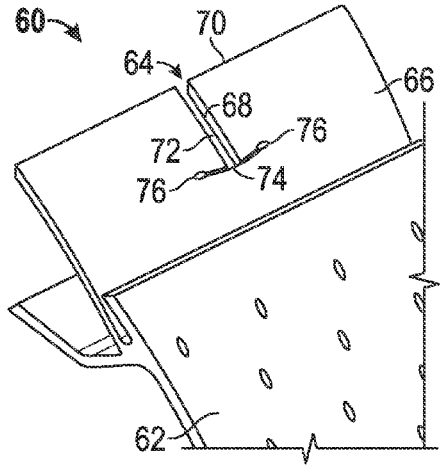
FIG. 5 is an enlarged perspective view of a portion of a combustion liner wall defining a relief slot embodying the present invention.

FIG. 5 illustrates a combustion liner 60 having a wall 62 defining an advanced geometry relief slot 64 in an upper portion or aft seal ring 66 thereof in accordance with present invention. The relief slot 64 defined by the wall or aft seal ring 66 of the combustion liner 60 includes a first slot portion 68 extending from a first end 70 of the wall 66 to a termination point 72. The relief slot 64 defined by the wall 66 further includes an arcuate slot portion 74 intersecting the termination point 72 of the first slot portion 68, and a generally circular aperture defined by the wall 66 at each end 76 of the arcuate slot portion 74. At least a portion of one of the slots extends through a thickness of the wall 66. As shown in FIG. 5, for example, substantially the entire relief slot 64 defined by the wall 66 extends through the thickness of the wall. Preferably, the arcuate slot portion 74 extends bidirectionally from the termination point 72 of the first slot portion 68 in a direction arcing toward the first end 70 of the wall 66. The arcuate slot portion 74 is illustrated as being generally U-shaped, but can take other configurations without departing from the scope of the present invention.

At the termination point 72 or base of the advanced geometry relief slot 64 the arcuate slot portion 74 is cut instead of a typical hole or ellipse. The tips or ends 76 of the arcuate slot portion 74 are disposed in a region of the wall 66 of the combustion liner 60 that operationally experiences a lower stress field than the termination point 72 or base of the relief slot 64. The tips or ends 76 of the arcuate slot portion 74 can also be stop drilled to reduce the local Kt.

Figure 6:
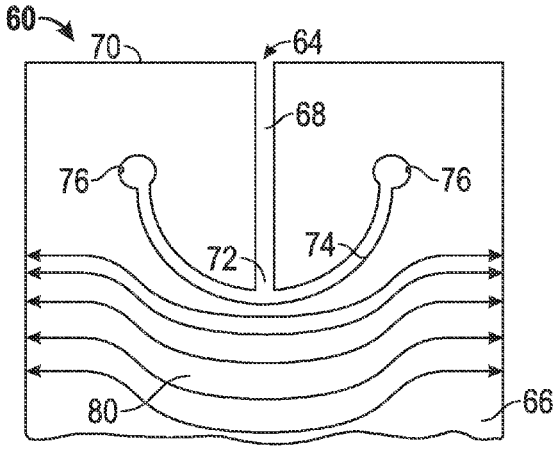
FIG. 6 is a plan view of the relief slot of FIG. 5 illustrating a hoop stress field in the vicinity of the relief slot.

FIG. 6 is an enlarged view of the relief slot 64 of FIG. 5 illustrating a hoop stress field 80 in the vicinity of the base 72 of the relief slot. As shown in FIG. 6, the hoop stress field 80 becomes less concentrated at a portion of the wall 66 adjacent to the arcuate slot portion 74 of the relief slot 64. The reduction in hoop stress field concentration increases crack initiation and fatigue growth life of the region in the wall experiencing the high hoop stress field.

An advanced geometry relief slot in accordance with the present invention can be cut using the current slot creation process or conventional machining processes. The advanced geometry relief slot preferably is processed at the same time that a conventional keyhole relief slot would have been processed. A width of the relief slot can be reduced relative to that of a conventional keyhole relief slot in order to not affect local airflow.

Relief slots are used or required in the aft seal rings of a combustion liner to reduce the hoop stress that occurs at that location. The advanced geometry relief slots embodying the present invention are configured to reduce the very high and very local stress concentrations experienced at the root of a typical keyhole slot by moving the sharp geometric high Kt's out of the local high hoop stress field. The advanced geometry relief slot thus increases crack initiation and fatigue crack growth life of the region in the aft seal ring experiencing the high hoop stress fight. The net result is a combustion liner assembly with improved component fatigue life. This directly translates into a significant life cycle cost reduction because of longer component in-service life.

As will be recognized by those of ordinary skill in the pertinent art, numerous modifications and substitutions can be made to the above-described embodiments of the present invention without departing from the scope of the invention. Accordingly, the preceding portion of this specification is to be taken in an illustrative, as opposed to a limiting sense.

What is claimed is:

1. A structure configured for relieving hoop stress in a wall, the structure comprising a wall being exposed to combustion gases, the wall defining a relief slot including a first slot portion extending from a first end of the wall to a termination point, an arcuate slot portion intersecting the termination point of the first slot portion, and a generally circular aperture defined in the wall at each end of the arcuate slot portion, said generally circular apertures being disposed at regions of the wall between the first end of the wall and the termination point of the first slot portion.

2. A structure as defined in claim 1, wherein at least a portion of one of the slot portions extends through a thickness of the wall.

3. A structure as defined in claim 1, wherein the arcuate slot portion extends bidirectionally from the termination point of the first slot portion toward the first end of the wall.

4. A structure as defined in claim 1, wherein the arcuate slot portion is generally U-shaped.

5. A combustion liner comprising an aft seal ring defining a relief slot in a wall of the combustion liner for relieving hoop stress in the wall, the combustion liner including a first slot portion extending from a first end of the wall to a termination point, an arcuate slot portion intersecting the termination point of the first slot portion, and a generally circular aperture defined in the wall at each end of the arcuate slot portion, said generally circular apertures being disposed at regions of the wall between the first end of the wall and the termination point of the first slot portion.

6. A combustion liner as defined in claim 5, wherein at least a portion of one of the slot portions extends through a thickness of the wall.

7. A combustion liner as defined in claim 5, wherein the arcuate slot portion extends bidirectionally from the termination point of the first slot portion toward the first end of the wall.

8. A combustion liner as defined in claim 5, wherein the arcuate slot portion is generally U-shaped.

9. An aft seal ring of a combustion liner, the combustion liner comprising a wall defining a relief slot for relieving hoop stress in the wall, the wall including a first slot portion extending from a first end of the wall to a termination point, an arcuate slot portion intersecting the termination point of the first slot portion, and a generally circular aperture defined in the wall at each end of the arcuate slot portion, said generally circular apertures being disposed at regions of the wall between the first end of the wall and the termination point of the first slot portion.

10. An aft seal ring as defined in claim 9, wherein at least a portion of one of the slot portions extends through a thickness of the wall.

11. An aft seal ring as defined in claim 9, wherein the arcuate slot portion extends bidirectionally from the termination point of the first slot portion toward the first end of the wall.

12. An aft seal ring as defined in claim 9, wherein the arcuate slot portion is generally U-shaped.

* * * * *